US005331385A

United States Patent [19]

Ohtsuka et al.

[11] Patent Number: 5,331,385

[45] Date of Patent: Jul. 19, 1994

[54] FIXING ROTATABLE MEMBER HAVING CONDUCTIVE PARTING LAYER AND FIXING APPARATUS USING SAME

[75] Inventors: Yasumasa Ohtsuka; Akihiko Takeuchi, both of Yokohama; Koichi Tanigawa; Hideo Nanataki, both of Tokyo, all of Japan

[73] Assignee: Canon Kabushiki Kaisha, Tokyo, Japan

[21] Appl. No.: 700,423

[22] Filed: May 15, 1991

[30] Foreign Application Priority Data

May 15, 1990 [JP] Japan ..... 2-123177
Sep. 6, 1990 [JP] Japan ..... 2-237903
Oct. 9, 1990 [JP] Japan ..... 2-272594

[51] Int. Cl.[5] ..... G03G 15/20
[52] U.S. Cl. ..... 355/290; 219/216
[58] Field of Search ..... 355/282, 285, 289, 290; 219/216, 469; 29/130, 132; 428/421, 446, 450; 492/53, 56

[56] References Cited

U.S. PATENT DOCUMENTS 3,809,854 5/1974 Sanders ..... 219/216
3,988,817 11/1976 Thettu ..... 29/130
4,179,601 12/1979 Tarumi et al. ..... 219/216
4,257,699 3/1981 Lentz ..... 29/132 X
4,272,179 6/1981 Seanor ..... 355/289
4,320,714 3/1982 Shimazaki et al. ..... 219/216 X
4,329,565 5/1982 Namiki et al. ..... 219/216
4,347,277 8/1982 Slama et al. ..... 428/421 X
4,719,489 1/1988 Ohkubo et al. ..... 355/290
4,763,158 8/1988 Schlueter, Jr. ..... 355/290 X
4,796,046 1/1989 Suzuki et al. ..... 355/284
4,819,020 4/1989 Matsushiro et al. ..... 219/216 X
4,829,931 5/1989 Mogi ..... 355/289 X
4,842,944 6/1989 Kuge et al. ..... 355/285 X
4,887,340 12/1989 Kato et al. ..... 29/130
5,011,401 4/1991 Sakurai et al. ..... 29/132 X
5,045,891 9/1991 Senba et al. ..... 355/289

FOREIGN PATENT DOCUMENTS 0090874 5/1984 Japan .
0094074 5/1986 Japan .
0024284 1/1989 Japan .

*Primary Examiner*—A. T. Grimley
*Assistant Examiner*—Robert Beatty
*Attorney, Agent, or Firm*—Fitzpatrick, Cella, Harper & Scinto

[57] ABSTRACT

An image fixing rotatable member and an image fixing apparatus using the rotatable member as a pressing rotatable member, having a fluorine resin tube over a rubber layer, wherein the volume resistivity of the rubber layer is lower than that of the fluorine resin tube so as to avoid charge build-up on the fluorine resin tube.

8 Claims, 9 Drawing Sheets

FIXING ROTATABLE MEMBER HAVING CONDUCTIVE PARTING LAYER AND FIXING APPARATUS USING SAME

FIELD OF THE INVENTION AND RELATED ART

The present invention relates to an image fixing apparatus for fixing an image on a recording material usable with an image forming apparatus such as a copying machine or printer, and to an image fixing roller usable with the fixing apparatus.

In a conventional image forming apparatus using an electrophotographic or electrostatic recording process, such as a copying machine or printer, an unfixed toner image carried on a transfer material is fixed on an image transfer material by a fixing apparatus as shown in FIG. 7, which comprises a fixing member in the form of a fixing roller 1 and a pressing roller 2. The fixing roller 1 includes a cylindrical core metal and a resin layer 12 thereon made of PFA, PTFE or the like having good heat resistivity and a good parting property. The pressing roller 2 is provided, on a core metal 17, with an elastic layer 13 made of silicone rubber or the like having a good parting property.

Around the fixing roller 1, there is disposed a temperature detector 9 for detecting the surface temperature of the fixing roller 1, and within the fixing roller, there is disposed a heat generating element in the form of a heater 10 for heating the fixing roller. The temperature detector 9 detects the surface temperature of the fixing roller 1, and in response to the detection, a control circuit (not shown) intermittently actuates the heater 10, so that the surface temperature of the fixing roller 1 is maintained at a predetermined temperature level.

The pressing roller 2 has a compression spring 3 engaged with a pressing arm 6 having an end portion 5, on a supporting member 4. The pressing roller 2 is thus press-contacted to the fixing roller 1 at a predetermined pressure. At a transfer material inlet between the fixing roller 1 and the pressing roller 2, there is an inlet guide 11 for guiding the transfer material into a nip formed between the fixing roller 1 and the pressing roller 2. At the outlet of the transfer material, a separation pawl 7 is disposed in contact with the fixing roller 1.

In such a fixing apparatus, the transfer material is introduced into the nip along the inlet guide, the transfer material is pressed between the fixing roller 1 and the pressing roller 2, and is heated, while the rollers are rotated, by which the toner image is continuously fused on the transfer material, while the transfer material being fed, by which the toner image is fixed on the transfer material. However, the elastic layer 13 of the pressing roller 2 is electrically charged to the polarity, the same as the toner, by triboelectric charging, an electrostatic repelling force is applied to the toner image, and the toner is deposited on the surface of the fixing roller 1 (so-called electrostatic off-set). In order to remove the toner from the surface of the fixing roller 1, a cleaning roller is used.

In consideration of the recent improvement in the parting property of the pressing roller, it is considered that the cleaning member is omitted to reduce the size and cost of the fixing apparatus. However, there still remains the problem of the contamination of the pressing roller with the toner particles and paper dust by the triboelectric charge. The problem is more acute in a fixing apparatus not using a cleaning member.

The device could be constructed so that the electric resistance of the pressing roller is decreased. However, this results in a reduction of the parting property of the roller. A structure satisfying the dual conditions that there be the sufficient prevention of electric charging and a sufficient parting property, has not yet been conceived.

Where the pressing roller is provided with a foamed material layer, it is difficult from the manufacturing standpoint to provide the foamed material layer with electric conductivity. A sufficient reduction of the electric resistance of the pressing roller has not yet been achieved.

SUMMARY OF THE INVENTION

Accordingly, it is a principal object of the present invention to provide an image fixing rotatable member and an image fixing apparatus using the rotatable member as a pressing rotatable member, wherein a sufficient parting property and a sufficient prevention of electric charging can be accomplished.

It is another object of the present invention to provide an image fixing rotatable member and an image fixing apparatus using the rotatable member as a pressing rotatable member wherein the rotatable member has a low electric resistance without increasing the hardness of the foamed material layer.

It is a further object of the present invention to provide an image fixing rotatable member and an image fixing apparatus using the rotatable member, wherein the use is made with conductive PFA tube.

It is a yet further object of the present invention to provide an image fixing rotatable member and an image fixing apparatus using the same wherein a rubber layer is electrically connected with a conductive base member without a porous elastic layer therebetween.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described in detail.

Figure 1:
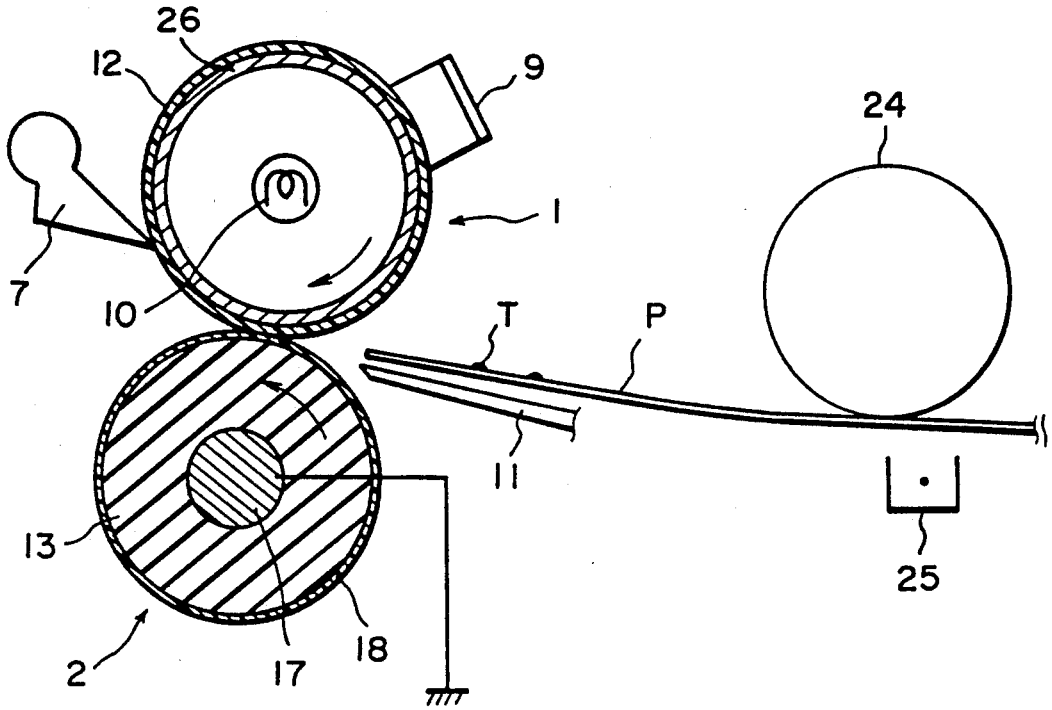
FIG. 1 is a sectional view of an apparatus according to a first embodiment of the present invention.

FIG. 1 shows an image forming apparatus according to a first embodiment of the present invention. It comprises a photosensitive drum 24, on which a toner image is formed with toner particles charged with a negative polarity by an unshown process means. An unfixed toner image on the photosensitive drum is transferred onto a transfer material by the electric charge of a polarity opposite from that of the toner, by a transfer charger 25. The distance, measured along the conveyance of the transfer material, between the transfer station and the fixing nip is shorter than the maximum length of the transfer or recording material. On the surface of the fixing roller 1 having a heater 10 therein, a temperature detector in the form of a thermister 9 is positioned, and the heater is on-off controlled so that the temperature detector 9 detects a constant temperature. Designated by a reference numeral 7 is a separation pawl contacting to the fixing roller surface to separate the recording material P from the fixing roller.

A pressing roller 2 is press-contacted to the fixing roller 1 to form a nip therebetween. A recording material P carrying an unfixed toner image T is subjected to the fixing operation by the heat and pressure which are applied thereto when it is passed through the nip formed by the rollers 1 and 2.

The fixing roller 1 has an electrically conductive core metal 26 made of a material such as aluminum or SUS and a fluorine resin coating thereon, which is made of an insulating material such as PFA (perfluoroalkoxy) or PTFE (polytetrafluoroethylene).

The pressing roller 2 comprises an electrically conductive core metal 17 which is made of a material such as aluminum or SUS or the like, an elastic layer which is made of silicone rubber 13 which is given electric conductivity by a containing surface active agent, metal powder, carbon powder or the like, and an electrically conductive PFA tube (GF tube ST, available from Gunze Kabushiki Kaisha, Japan, in which low resistivity carbon is dispersed) 18, bonded on the surface of the elastic layer.

The conductive PFA tube 18 may be coated on the rubber layer 13 using thermal shrinkage, but it is preferable that the tube 18 is bonded with the electrically conductive bonding agent.

The volume resistivity of the conductive PFA tube 18 is preferably $10^7$ ohm.cm approximately. The thickness of the tube is preferably 30–50 microns.

If a usual PFA tube is used, the triboelectric charge produced is accumulated because the volume resistivity thereof is as high as $10^{14}$ ohm.cm. Then, the electrostatic off-set can not be prevented. However, the conductive PFA tube used in this embodiment prevents the accumulation of the charge triboelectrically produced, and in addition, the electric charge flows to the ground through the bonding agent and the rubber 13, and therefore, the surface potential of the pressing roller does not increase, by which the offset is effectively prevented.

The resistivity of the pressing roller 2 is preferably such that the resistivity between the nip in use of the apparatus and the core metal 17 is $10^8$–$10^{12}$ ohm.cm. This range is effective to prevent the charging up and to prevent the escape of the electric charge from the backside of the recording material. If the charge-up occurs, an offset is produced, and in addition, the escape of the electric charge reduces the toner retaining force relative to the recording material with the result of the production of the off-set.

The fluorinated resin layer may be formed by coating powdery or liquid PFA or PTFE containing the low resistance material such as metal powder or the like, on the surface of the pressing roller. In this case, however, the fluorinated resin has to be sintered at a high temperature, and therefore, the rubber material below it is liable to be deteriorate during the sintering operation. In addition, the dispersion of the low resistance material is better in the case of the PFA tube, and therefore, local significant deterioration in the parting property attributable to the non-uniform dispersion, can be prevented.

Embodiment 2

Figure 2:
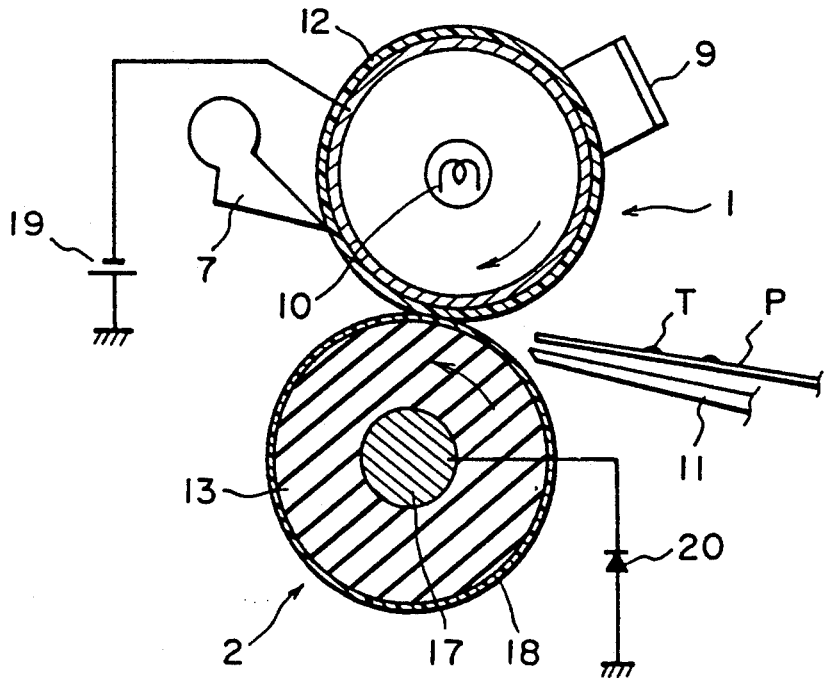
FIG. 2 is a sectional view of an apparatus according to a second embodiment of the present invention.

Referring to FIG. 2, the second embodiment of the present invention will be described, in which the same reference numerals as in the first embodiment are assigned to the elements having the corresponding functions, and the detailed description thereof are omitted, for simplicity.

This embodiment is different from the first embodiment that the core metal 17 of the pressing roller 2 is grounded through a diode 20 and in that the core metal of the fixing roller 1 is connected with a power source 19. As shown in FIG. 2, in this embodiment, when the toner T which has been charged with a negative polarity is used, the diode 20 is connected in such a direction that the positive charge on the backside of the transfer material P is not released and the negative charge produced by the triboelectric charging is released. Therefore, the second embodiment is further effective for the prevention of the off-set. In addition, at this time, the core metal of the fixing roller 1 is supplied with a potential having the same polarity as the toner T from the power source 19. By doing so, the toner offset can be further prevented.

Embodiment 3

Figure 3:
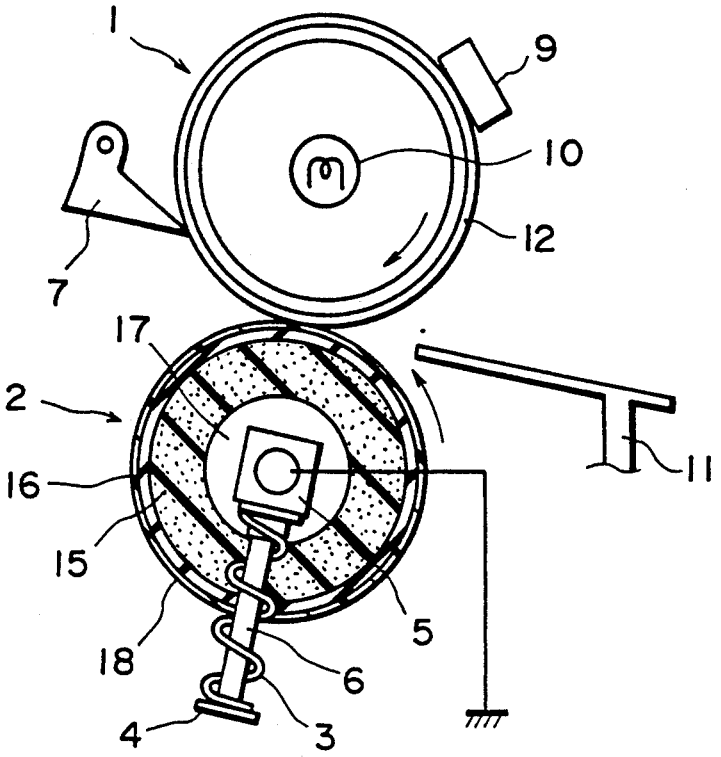
FIG. 3 is a sectional view of an apparatus according to a third embodiment of the present invention.

Referring to FIG. 3, a description will be provided as to a third embodiment of the present invention, wherein the same reference numerals as in the first embodiment are assigned to the elements having the corresponding functions, by which the detailed description thereof are omitted for simplicity.

The present embodiment is different from the first embodiment in that the elastic layer is constituted by a sponge layer and a rubber layer. If the elastic layer of the pressing roller is constituted by a single layer of rubber, there is a tendency for the hardness of the pressing roller to be high. Therefore, the transfer material is more easily creased. More particularly, the production of a crease occurs easily when an envelope is used. In consideration of the above, the pressing roller of this embodiment is constituted by a sponge layer 15 made of silicone sponge or the like and a rubber layer 16. The surface layer is provided by wrapping the conductive PFA tube 18 thereon.

For comparison, a pressing roller having an elastic layer in the form of a single layer was produced. The thickness of the tube was 50 microns, and the lower elastic layer was made of silicone rubber having a thickness of 7 mm and having a JIS-A hardness of 20 degrees. The outer diameter of the pressing roller was 30 mm. The Asker C hardness of the product was 64 degrees.

According to this embodiment, a pressing roller was produced, which used the same conductive PFA tube. The elastic layer was constituted by a silicone sponge layer having a thickness of 6 mm and the Asker C hardness of 40 degrees and a silicone rubber layer having a thickness of 1 mm and a JIS-A hardness of 20 degrees. The Asker C hardness of the final product was 40 degrees.

In order to provide a nip width of 4 mm, the former product required a total pressure of 20 kg, but the latter product requires only 10 kg of total pressure. The latter did not product the crease.

In this embodiment, too, the off-set was not produced, and the parting properties were good.

Embodiment 4

Figure 4:
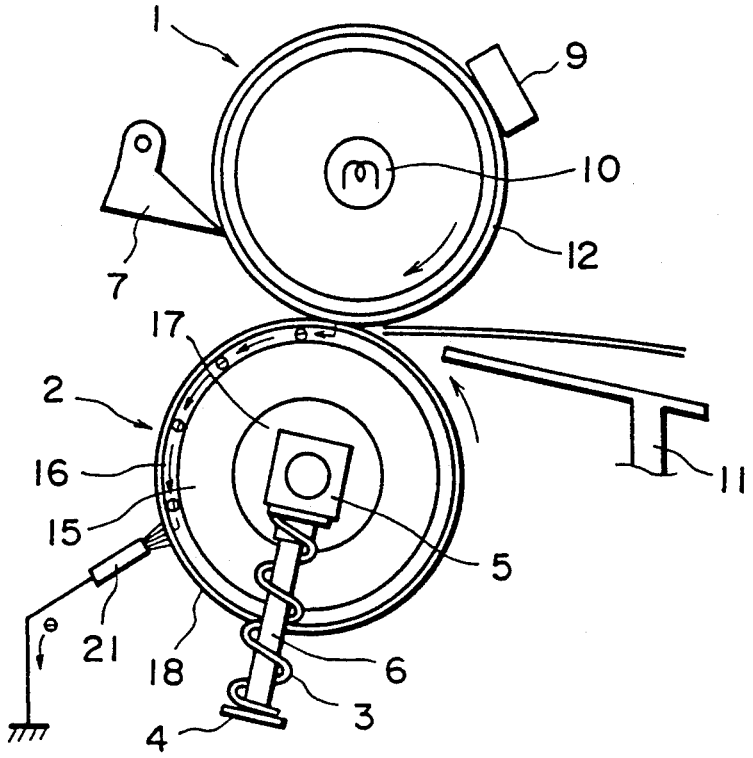
FIG. 4 is a sectional view of an apparatus according to a fourth embodiment of the present invention.

Referring to FIG. 4, a fourth embodiment will be described, wherein the same reference numerals as in the third embodiment are assigned to the elements having the corresponding functions, by which the detailed descriptions thereof are omitted for simplicity.

This embodiment is similar to the third embodiment, but comprises an electrically discharging brush 21. The sponge layer 15 used in the third embodiment involves difficulty in providing it with the electrical conductivity with the liability of the defects due to the vulcanization. By using the discharging brush 21, the surface charge is removed. By doing so, the electric charge flows from the conductive PFA tube through the conductive rubber layer, the conductive PFA tube and the discharging brush 21 to the ground.

According to this embodiment, the toner offset can be further effectively prevented.

Embodiment 5

Figure 5:
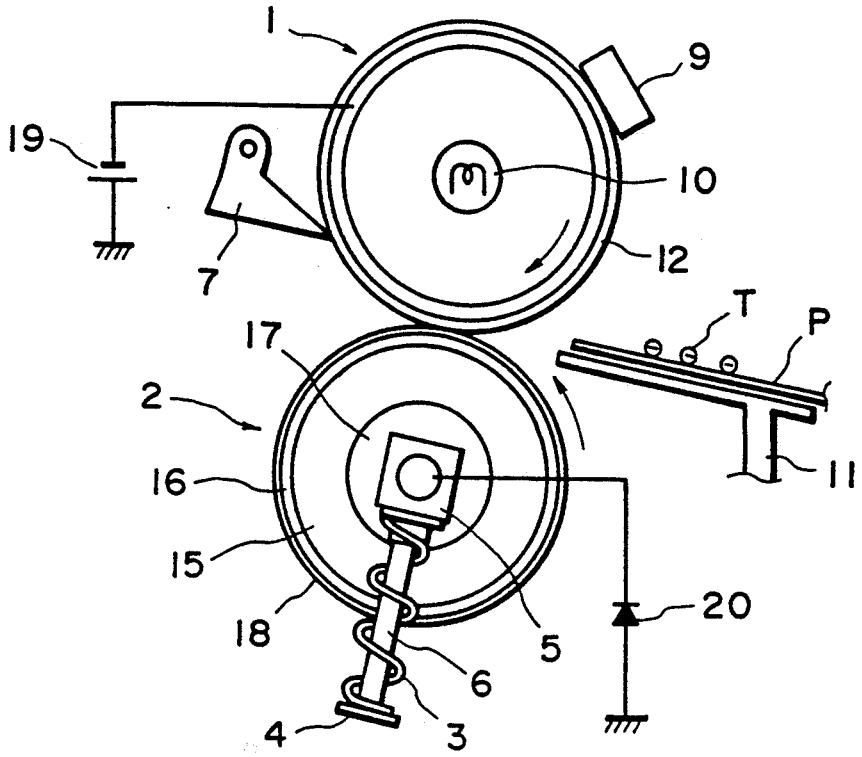
FIG. 5 is a sectional view of an apparatus according to a fifth embodiment of the present invention.

Referring to FIG. 5, a fifth embodiment will be described, wherein the same reference numerals as in the third embodiments are assigned to the elements having the corresponding functions, by which the detailed description thereof are omitted for simplicity.

The present embodiment is different from the third embodiment in that an electric power source 19 and a diode 20 are used. As shown in FIG. 5, when the toner used is charged with a negative polarity, the core metal 17 of the fixing roller 1 is connected with the power source 19 to provide the potential having the same polarity as the toner. In addition, the core metal of the pressing roller 2 is connected with a diode 20 to provide a potential having the polarity opposite from that of the toner. As a result, the toner is urged to the transfer material by the electrostatic force, thus preventing the production of the offset.

According to this embodiment, the off-set can be further effectively prevented.

Embodiment 6

Figure 6:
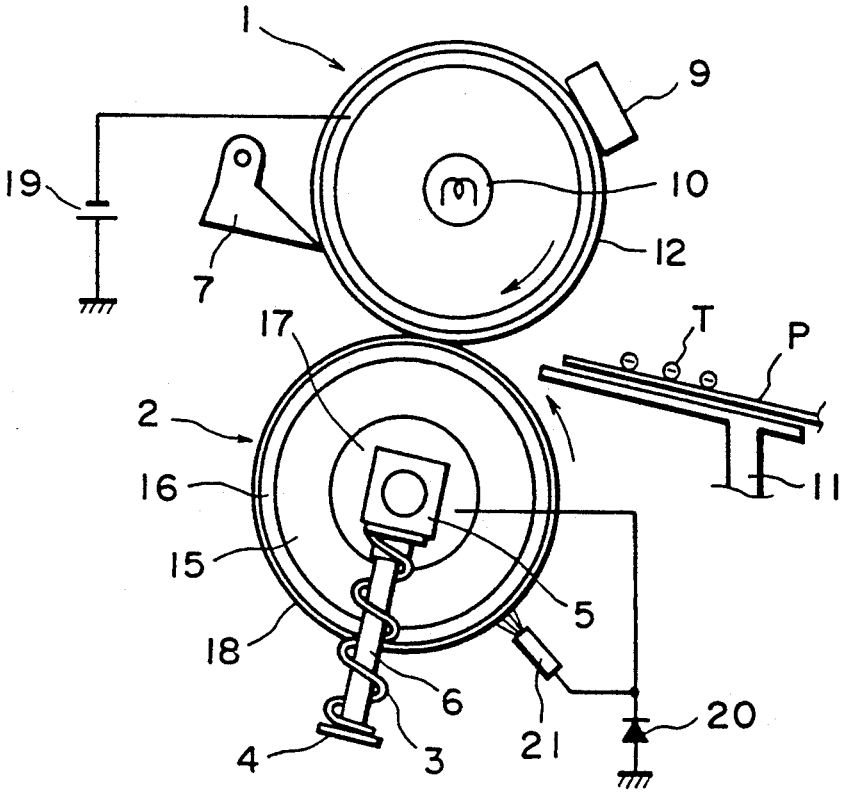
FIG. 6 is a sectional view of an apparatus according to a sixth embodiment of the present invention.
Figure 7:
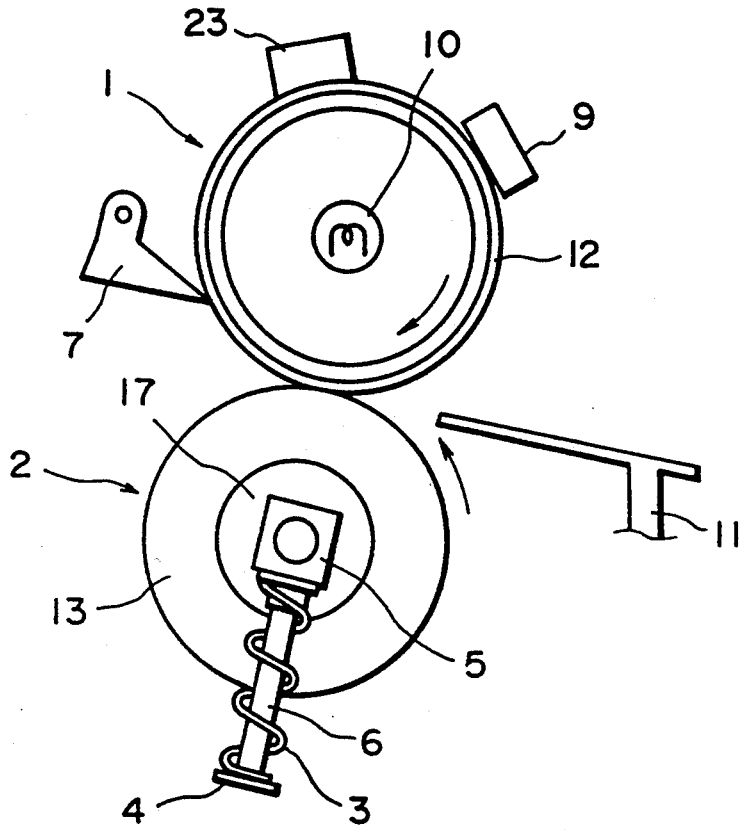
FIG. 7 PRIOR ART
FIG. 7 is a sectional view of a conventional apparatus.

Referring to FIG. 6, a sixth embodiment will be described, wherein the same reference numerals as in the fifth embodiment are assigned to the elements having the corresponding functions, by which the detailed description thereof are omitted for simplicity.

This embodiment is different from the fifth embodiment in that the discharging brush and the core metal are grounded through a diode, as shown in Figure 6. With this structure of this embodiment, the offset can be effectively prevented.

In the embodiments described in foregoing, wherein the diode is used, when the toner used is charged to the positive polarity, the directions of the diode and the power source polarities are reversed. In the third—sixth embodiments, a rubber layer 16 may be inserted between the sponge layer 15 and the tube layer 18 to improve the bonding property and the dimensional accuracy.

Figure 8:
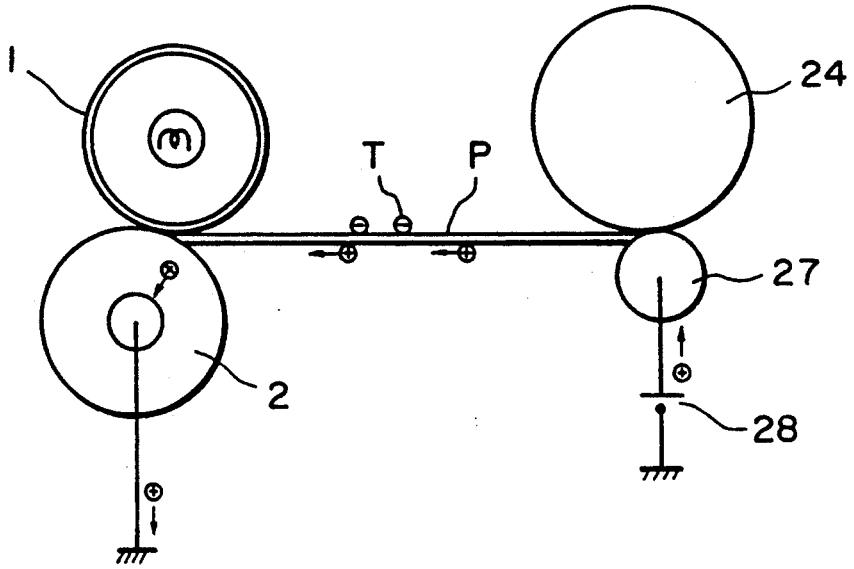
FIG. 8 shows flow of a transfer current between the image transfer and the image fixing.

Referring to FIG. 8, a cause of the improper image transfer is illustrated. In the apparatus involved, the transfer charger comprises an image transfer roller 27 to which a voltage is applied from a high voltage source 28. When the recording material P bridges between the nip of the fixing apparatus and the nip in the transfer station, the transfer current flows to the ground through the pressing roller under a high humidity condition, as shown in FIG. 8. If this occurs, the transfer action becomes improper. The problem is avoided by the use of the diode since the by-passing of the transfer current is prevented although the resistance of the pressing roller is sufficiently low.

The resistivity in the embodiment of FIG. 1 will be described. The volume resistivity of the conductive elastic layer 13 is preferably $10^3$–$10^5$ ohm.cm. If the resistance is too high, the surface of the pressing roller is not easily reduced. In an electrophotographic apparatus wherein an unfixed toner image is transferred from a photosensitive member onto the recording material by means of a transfer charger, the electric charge on the backside of the recording material flows to the ground if the volume resistivity of the elastic layer is smaller than $10^3$ ohm.cm. If this occurs, the force for retaining the toner on the recording material is reduced with the result of production of the offset. With the recent tendency for the reduction of the size of the apparatus, the distance between the transfer station and the fixing station becomes smaller than the maximum length of the usable recording material. If the flow of the electric charge from the recording material is significant, improper image transfer action occurs. For example, when the fixing roller has a surface layer of electrically conductive rubber having the volume resistivity of $10^3$ ohm.cm, the transfer current flows out with the result of improper image transfer.

Therefore, the volume resistivity of the elastic layer is preferably not less than $10^3$ ohm.cm.

If the volume resistivity of the fluorine resin such as PFA resin or the like is smaller than $10^7$ohm.cm, it is difficult to form it, and also, the parting property decreases.

In addition, it is difficult to form the resin such as PFA resin or the like if it has the volume resistivity lower than $10^7$ ohm.cm. However, if the thickness of the PFA layer having the volume resistivity not less than $10^7$ ohm.cm is reduced, and if the volume resistivity of the rubber layer under the PFA layer is further reduced, the resistivity of the pressing roller between the nip and the ground can be advantageously controlled by the thickness and/or the prescription of the material.

If the resistivity of the surface is too large, it is difficult to prevent the electric charging, and therefore, the volume resistivity of the fluorinated resin layer as the surface parting layer is preferably not more than $10^{11}$ ohm.cm.

Actually, when the nip has a width of 4 mm and a length of 222 mm, the resistivity of the pressing roller between the ground and the nip is satisfactorily $10^3$ ohm.-$10^{11}$ ohm. The conductive rubber layer and the conductive PFA layer are combined so as to satisfy this range, by which the local void of the image transfer and the toner off-set can be prevented.

Embodiment 7

Figure 9:
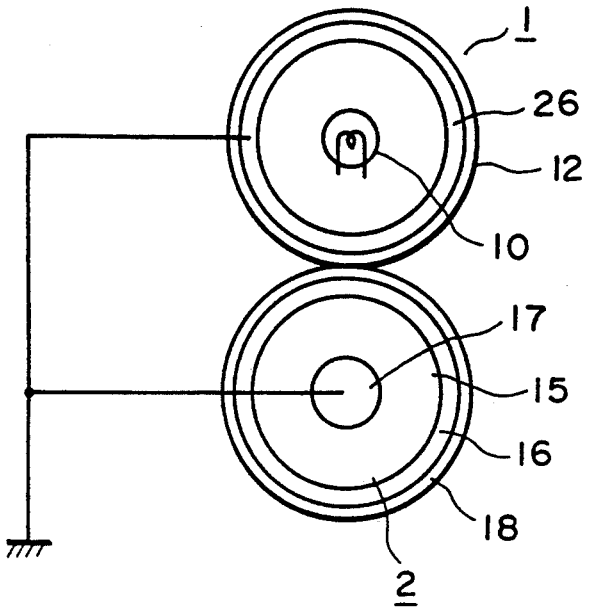
FIG. 9 is a sectional view of an image fixing apparatus according to an embodiment of the present invention.
Figure 10A:
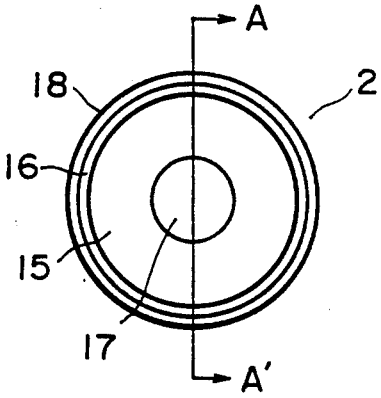
FIGS. 10A and 10B are sectional views of the pressing roller used in the apparatus of FIG. 9 embodiment.
Figure 10B:
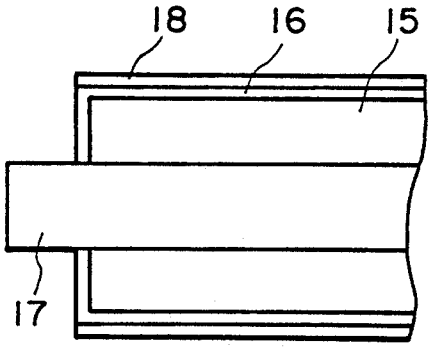

Referring to FIGS. 9 and 10, a seventh embodiment of the present invention will be described. The fixing roller 1 comprises a core metal 26 and a parting resin such as PFA or PTFE resin, coated thereon. The pressing roller 2 has a core metal 17 and a silicone sponge layer 15 (Asker C hardness of 30 degrees and a thickness of 5 mm), a conductive silicone rubber layer 16 having an Asker C hardness of 20 degrees, a thickness of 1 mm and a volume resistivity of $10^3$–$10^5$ ohm.cm, and a surface layer in the form of a PFA tube having a thickness of 30–150 microns and a volume resistivity of $10^7$–$10^{10}$ ohm.cm in which the carbon black is dispersed. FIGS. 10A and 10B show a cross-sectional view and a longitudinal sectional view, respectively. The conductive silicone rubber layer is bonded on the core metal so as to cover the opposite end surfaces, as shown in FIG. 10B. The bonding agent is also electrically conductive. Because of the multi-layer structure of the pressing roller, the following advantages are provided.

(1) The sponge (porous layer) does not contain the conductive material, and therefore, is insulating, and therefore, the rubber hardness can be maintained low, by which the width of the nip can be large enough to fix the images at a high speed without crease.

(2) The pressure distribution in the nip is made smooth by the use of the sponge, and therefore, the crease is not produced in an envelope.

(3) Since the surface layer is PFA layer, the parting property is maintained satisfactory for a long period of time; and since the electric charge produced on the surface by the triboelectric charging flows to the ground through the carbon black, the conductive silicone rubber layer and the core metal, the charge potential becomes low.

The core metals of the fixing roller and the pressing roller are grounded, as shown in the figure, by which the potential due to the surface charge of the roller is reduced. Thus, even if the electric charge having the polarity the same as the toner is accumulated on the surface of the pressing roller, the electric lines of force due to the electric charge are generally directed to the conductive silicone rubber layer right below the PFA layer, and therefore, they do not provide a repelling force to the toner image, and therefore, the production of the off-set can be prevented.

Embodiment 8

Figure 11:
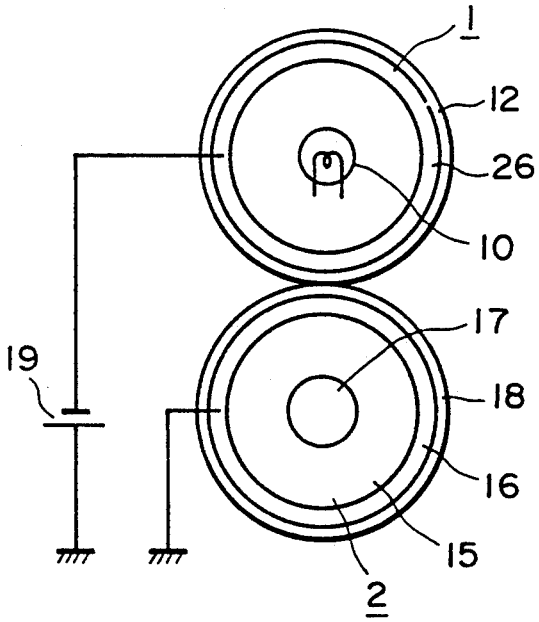
FIGS. 11 and 13 are sectional views of the apparatus according to further embodiments of the present invention.
Figure 12A:
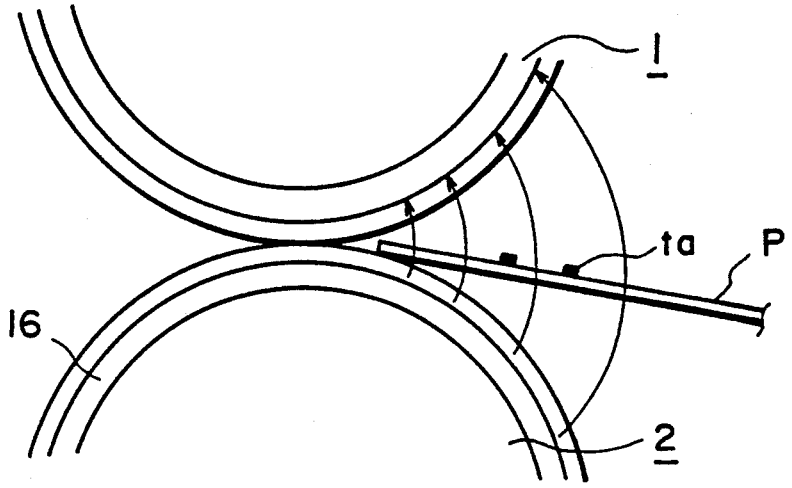
FIG. 12A illustrates the electric field in the neighborhood of the nip in the apparatus of FIGS. 3 and 5.
Figure 12B:
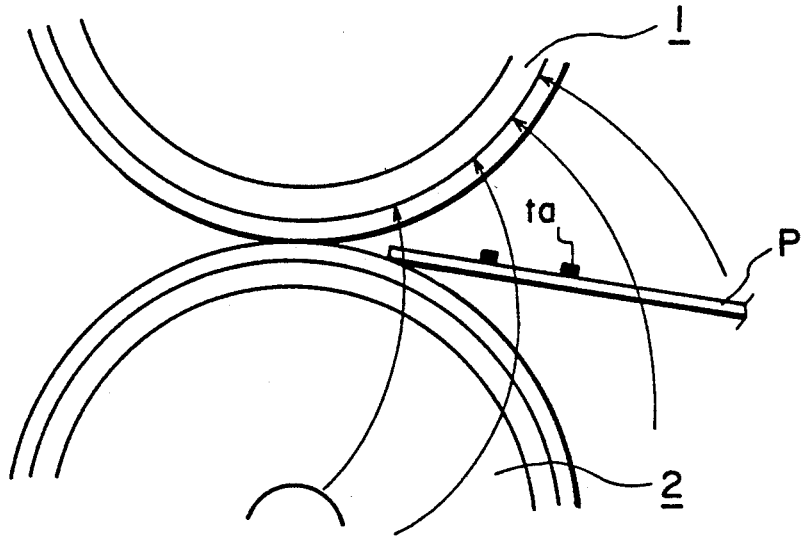
FIG. 12B shows the electric field in the neighborhood of the nip in a conventional apparatus.

FIG. 11 illustrates an eighth embodiment. In this embodiment, the toner is charged to the negative polarity. The fixing roller 1 is supplied with a negative bias voltage from the power source 19, by which the toner receives repelling force, by which the toner off-set can be prevented. In this embodiment, the core metal of the pressing roller is grounded, so that the electric lines of force resulting from the fixing roller bias are directed from the pressing roller to the fixing roller, by which the force can be produced in the direction to confine the toner on the image carrying material. Therefore, the toner off-set can be further prevented. FIG. 12 shows the electric lines of force in the neighborhood of the nip. FIG. 12A shows the distribution of the electric lines of force in the present invention, whereas FIG. 12B shows the same in a conventional apparatus. It will be understood that in the present invention, the conductive silicone rubber layer function as an opposite electrode, and therefore, the electric lines of force extend in a direction perpendicular to the image carrying material, so that the toner is urged to the image carrying material. Thus, the direction of the electric lines of force are extended in efficient directions, so that the bias which has been required to be approximately −1.5 KV in the conventional apparatus becomes required to be only −600 V. Therefore, the leakage or the noise production are reduced.

Figure 13:
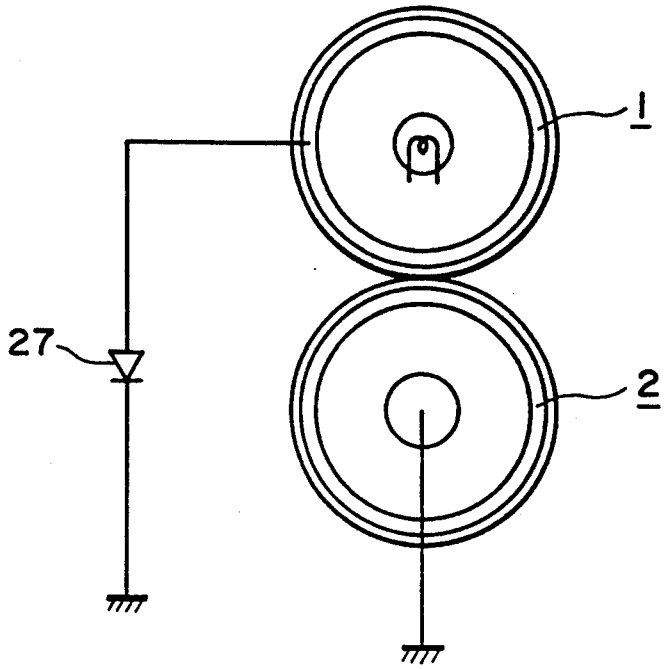

In this embodiment, the fixing roller is supplied with the bias voltage by the electric source. However, it is a possible alternative, as shown in FIG. 13 that the electric charge having the same polarity as the toner is retained on the core metal by a diode 27.

Embodiment 9

Figure 14:
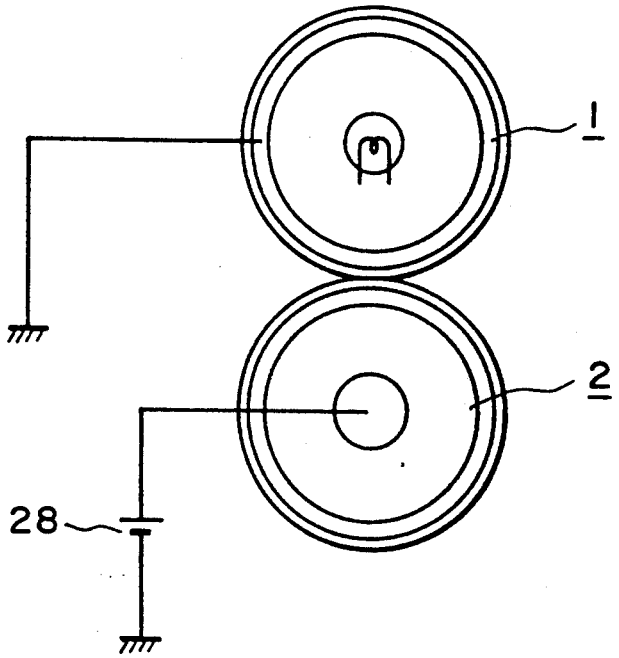
FIGS. 14–18 are longitudinal sectional views of an apparatus according to further embodiments.

In the foregoing embodiment, the fixing roller is supplied with the bias voltage, but in this embodiment, the bias voltage is applied to the core metal of the pressing roller. This is shown in Figure 14, wherein the case of the toner negatively charged is dealt with. The core metal of the pressing roller is supplied with a positive voltage. By this bias, the toner is attracted from the backside of the image carrying material, and therefore, the toner off-set is reduced. When the bias voltage is applied to the fixing roller, it would be required to provide some measures for the electric insulation from the temperature detecting element and the heater. However, there is no such means around the pressing roller, and therefore, the measure is not required in this embodiment.

Figure 15:
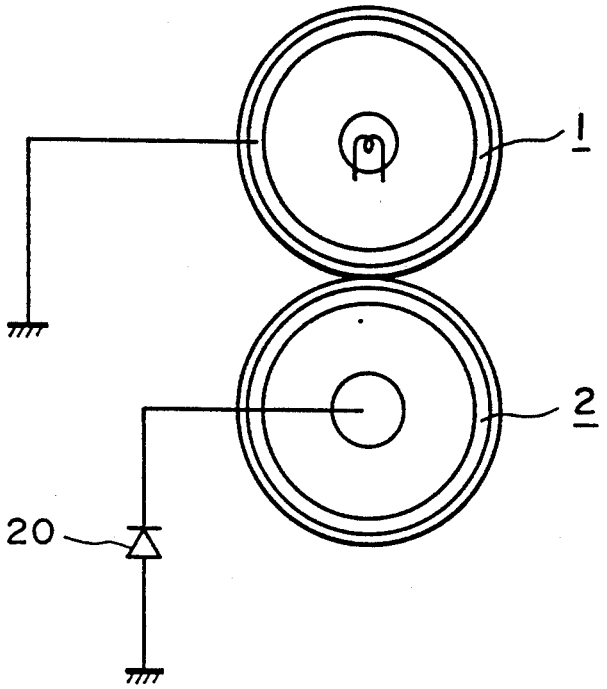

As shown in FIG. 15, a diode may be connected so as to retain the positive polarity of the core metal of the pressing roller.

Embodiment 10

Figure 16:
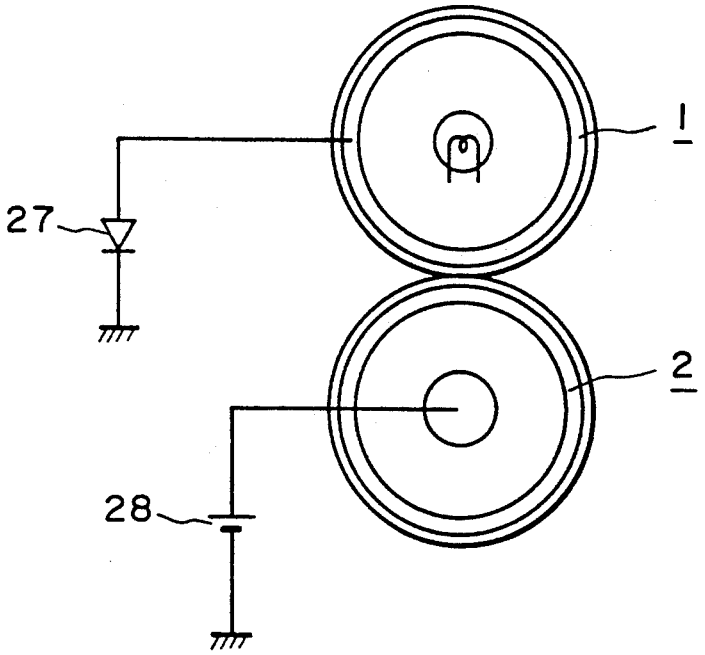

FIG. 16 shows a tenth embodiment, wherein a diode is connected such that the fixing roller retains only the negative charge among the electric charge produced by the triboelectric charge due to the friction with the image carrying member and/or the pressing roller. The pressing roller is supplied with a positive bias voltage so as to attract the toner.

Embodiment 11

Figure 17:
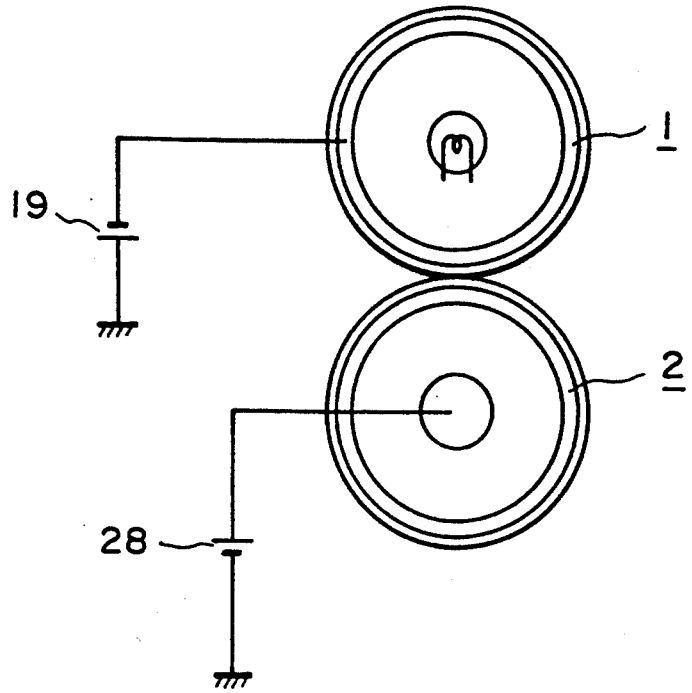

FIG. 17 illustrates an eleventh embodiment, wherein the bias voltages are applied to both of the fixing roller and the pressing roller.

Embodiment 12

Figure 18:
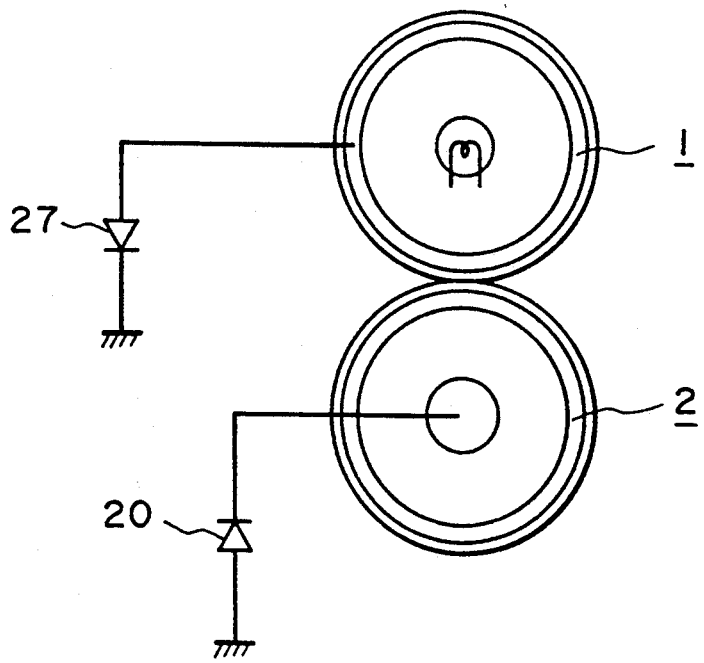

FIG. 18 shows a twelfth embodiment, wherein the diodes are connected both to the fixing roller and the pressing roller.

In the foregoing embodiments, a conductive silicone rubber is inserted between the conductive PFA tube and the sponge layer. In this embodiment, however, a conductive bonding material instead of the silicone rubber layer is sandwiched. Similarly to the case of FIG. 10B, it is electrically connected with the core metal at the end surface or surfaces. The bonding material is preferably a usual silane coupling agent mixture in which carbon black is dispersed. The volume resistivity of the bonding agent is approximately $10^2$ ohm.cm.

In this embodiment, the polarity of the bias voltage is properly selected by one skilled in the art depending on the polarity of the toner. In addition, the thicknesses of the sponge layer, the conductive silicone rubber layer and the conductive PFA tube layer are properly determined by one skilled in the art.

The surface parting layer may be of fluorinated resin such as PTFE or PFA, but the PFA material is preferable.

In the foregoing description, the fixing rotatable member is in the form of a roller, but it may be in the form of a belt.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member for carrying an unfixed image;

image transfer means for electrostatically transferring the unfixed image from said image bearing member onto a recording material;

a fixing rotatable member contactable with that surface of the recording material which carries the unfixed image; and a pressing rotatable member cooperative with said fixing rotatable member to form a nip therebetween, said pressing rotatable member being contactable to that surface of said recording material which has received electric charge from said image transfer means, wherein said pressing rotatable member comprises a conductive core member, a rubber layer on said core member and a surface fluorine resin layer having a lower volume resistivity than said rubber layer, wherein resistance between the core member of said pressing rotatable member and the nip is $10^8$–$10^{12}$ ohm.cm.

2. An apparatus according to claim 1, wherein said rubber layer and said surface resin layer contain low resistance material.

3. An apparatus according to claim 1, wherein said surface fluorine resin layer is in the form of a tube.

4. An apparatus according to claim 3, wherein the tube has a thickness of 30–50 microns.

5. An apparatus according to claim 3, wherein said tube has a thickness which is smaller than that of said rubber layer.

6. An apparatus according to claim 3, wherein said tube is bonded to said rubber layer with a conductive adhesive.

7. An apparatus according to claim 1, wherein said core member is grounded.

8. An apparatus according to claim 1, wherein said fixing rotatable member has an insulative surface layer.

* * * * *

UNITED STATES PATENT AND TRADEMARK OFFICE

CERTIFICATE OF CORRECTION

PATENT NO. : 5,331,385

DATED : July 19, 1994

INVENTOR(S) : Yasumasa Ohtsuka, et al

It is certified that error appears in the above-indentified patent and that said Letters Patent is hereby corrected as shown below:

On the title page:

[56] References Cited:

FOREIGN PATENT DOCUMENTS

"0090874 5/1984 Japan .
0094074 5/1986 Japan .
0024284 1/1989 Japan ." should read --59-90874 5/1984 Japan .
61-94074 5/1986 Japan .
1-24284 1/1989 Japan .--.

COLUMN 4:

Line 21, "be" should be deleted.

COLUMN 5:

Line 21, "product" should read --produce--.

Signed and Sealed this

Seventh Day of February, 1995

Bruce Lehman

*Attest:*

BRUCE LEHMAN

*Attesting Officer*

*Commissioner of Patents and Trademarks*